US007023313B2

(12) United States Patent
Sutardja

(10) Patent No.: US 7,023,313 B2
(45) Date of Patent: Apr. 4, 2006

(54) POWER INDUCTOR WITH REDUCED DC CURRENT SATURATION

(75) Inventor: Sehat Sutardja, Los Altos Hills, CA (US)

(73) Assignee: Marvell World Trade Ltd., St. Michael (BB)

( * ) Notice: Subject to any disclaimer, the term of this patent is extended or adjusted under 35 U.S.C. 154(b) by 157 days.

(21) Appl. No.: 10/621,128

(22) Filed: Jul. 16, 2003

(65) Prior Publication Data

US 2005/0012582 A1 Jan. 20, 2005

(51) Int. Cl.
*H01F 17/06* (2006.01)

(52) U.S. Cl. ..... 336/178; 336/175; 29/602.1

(58) Field of Classification Search ..... 336/175, 336/174, 229, 92, 84, 178, 110, 212; 29/602.1
See application file for complete search history.

(56) References Cited

U.S. PATENT DOCUMENTS

| | | | | |
|---|---|---|---|---|
| 4,527,032 | A * | 7/1985 | Young et al. | 219/645 |
| 4,536,733 | A | 8/1985 | Shelly et al. | |
| 4,578,664 | A | 3/1986 | Kinzler et al. | |
| 5,204,809 | A | 4/1993 | Andresen | |
| 6,191,673 | B1 * | 2/2001 | Ogura et al. | 336/84 R |
| 6,310,534 | B1 | 10/2001 | Brunner | |
| 6,356,179 | B1 * | 3/2002 | Yamada | 336/175 |
| 6,362,986 | B1 | 3/2002 | Schultz et al. | |
| 6,459,349 | B1 * | 10/2002 | Giday et al. | 336/178 |
| 6,686,823 | B1 * | 2/2004 | Arntz et al. | 336/174 |

FOREIGN PATENT DOCUMENTS

| | | | |
|---|---|---|---|
| DE | 3622190 | A | 1/1988 |
| EP | 0484074 | A | 5/1992 |
| EP | 0895257 | A | 2/1999 |
| GB | 2318691 | A | 4/1998 |
| JP | 057193007 | | 11/1982 |
| JP | 02251107 | | 10/1990 |
| JP | 06260869 | | 9/1994 |
| JP | 11008123 | | 1/1999 |
| JP | 11074125 | A | 3/1999 |
| JP | 11204354 | A | 7/1999 |
| JP | 2003332141 | A | 11/2003 |
| WO | WO00/74089 | A1 | 12/2000 |
| WO | WO02/095775 | A1 | 11/2002 |

OTHER PUBLICATIONS

European Search Report for Appl. No. 04011558.6, 2 pages.
European Search Report for Appl. No. 04010841, 2 pages.
European Search Report for Appl. No. 04020571.8, 3 pages.
European Search Report for Appl. No. 04020568.4, 3 pages.
"Understanding Ferrite Bead Inductors", http://www.murata.com, pp. 23-25 (unknown date of publication).
"Using Ferrite Beads to Keep RF Out Of TV Sets, Telephones, VCR's, Burglar Alarms and Other Electronic Equipment", http://www.antennex.com, pp. 1-4 (unknown date of publication).

* cited by examiner

*Primary Examiner*—Anh Mai

(57) ABSTRACT

A power inductor includes a magnetic core material having first and second ends. An inner cavity arranged in the magnetic core material extends from the first end to the second end. A conductor passes through the cavity. A slotted air gap arranged in the magnetic core material extends from the first end to the second end.

69 Claims, 6 Drawing Sheets

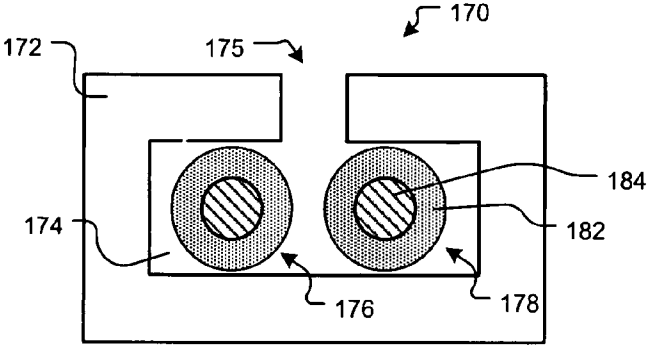
FIG. 16
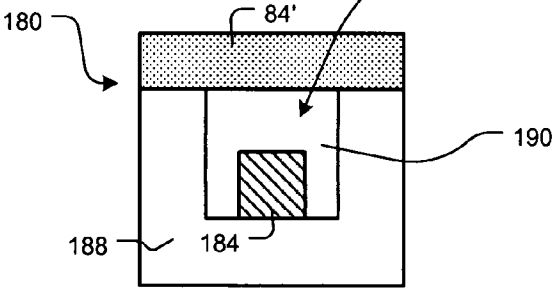
FIG. 17
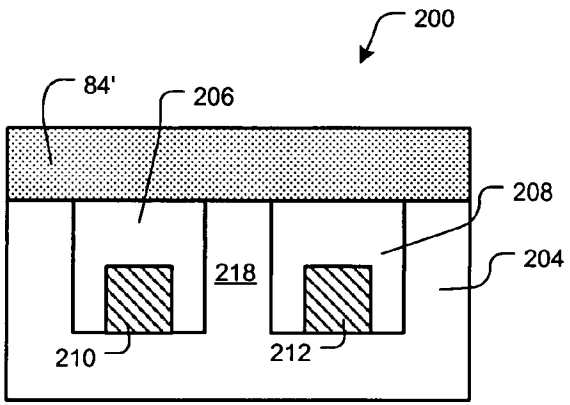
FIG. 18
FIG. 19

POWER INDUCTOR WITH REDUCED DC CURRENT SATURATION

FIELD OF THE INVENTION

The present invention relates to inductors, and more particularly to power inductors having magnetic core materials with reduced levels of saturation when operating with high DC currents and at high operating frequencies.

BACKGROUND OF THE INVENTION

Inductors are circuit elements that operate based on magnetic fields. The source of the magnetic field is charge that is in motion, or current. If current varies with time, the magnetic field that is induced also varies with time. A time-varying magnetic field induces a voltage in any conductor that is linked by the magnetic field. If the current is constant, the voltage across an ideal inductor is zero. Therefore, the inductor looks like a short circuit to a constant or DC current. In the inductor, the voltage is given by:

$$v = L\frac{di}{dt}.$$

Therefore, there cannot be an instantaneous change of current in the inductor.

Inductors can be used in a wide variety of circuits. Power inductors receive a relatively high DC current, for example up to about 100 Amps, and may operate at relatively high frequencies. For example and referring now to FIG. 1, a power inductor 20 may be used in a DC/DC converter 24, which typically employs inversion and/or rectification to transform DC at one voltage to DC at another voltage.

Referring now to FIG. 2, the power inductor 20 typically includes one or more turns of a conductor 30 that pass through a magnetic core material 34. For example, the magnetic core material 34 may have a square outer cross-section 36 and a square central cavity 38 that extends the length of the magnetic core material 34. The conductor 30 passes through the central cavity 38. The relatively high levels of DC current that flow through the conductor 30 tend to cause the magnetic core material 34 to saturate, which reduces the performance of the power inductor 20 and the device incorporating it.

SUMMARY OF THE INVENTION

A power inductor according to the present invention includes a magnetic core material having first and second ends. An inner cavity in the magnetic core material extends from the first end to the second end. A conductor passes through the cavity. A slotted air gap in the magnetic core material extends from the first end to the second end.

In other features, the power inductor is implemented in a DC/DC converter. The slotted air gap is arranged in the magnetic core material in a direction that is parallel to the conductor. An eddy current reducing material that reduces magnetic flux reaching the conductor is arranged adjacent to inner and/or outer openings of the slotted air gap. The conductor is arranged in the cavity along a first side of the magnetic core material. The slotted air gap is arranged in a second side of the magnetic core material that is opposite the first side. The conductor passes through the cavity along a first side of the magnetic core material. The slotted air gap is arranged in a second side that is adjacent to the first side.

In still other features, a second conductor passes through the cavity along the first side. A projection of the magnetic core material extends outwardly from the first side between the conductor and the second conductor. The slotted air gap is arranged in the opposite side of the magnetic core material above the projection.

In still other features, a second cavity is arranged in the magnetic core material. A center section of the magnetic core material is located between the cavity and the second cavity. A second conductor passes through the second cavity adjacent to the first side. A second slotted air gap is arranged in a third side that is opposite to the second side.

In yet other features, a second cavity is arranged in the magnetic core material. A center "T"-shaped section is arranged in the magnetic core material between the cavity and the second cavity. A second conductor passes through the second cavity adjacent to the first side. The first conductor is arranged adjacent to the first side.

In still other features, the slotted air gap is arranged in a second side that is opposite the first side on one side of the center "T"-shaped section. A second slotted air gap is arranged in the second side that is opposite the first side on an opposite side of the center "T"-shaped section. The slotted air gap is arranged in a second side of the magnetic core material that is adjacent to the first. A second slotted air gap is arranged in a third side that is opposite the second side.

In still other features, the eddy current reducing material has a magnetic permeability that is lower than the magnetic core material. The eddy current reducing material includes a soft magnetic material.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

FIG. 16 is a cross sectional view of a magnetic core material with a slotted air gap and one or more insulated conductors;

FIG. 17 is a cross sectional view of a "C"-shaped magnetic core material and an eddy current reducing material;

FIG. 18 is a cross sectional view of a "C"-shaped magnetic core material and an eddy current reducing material with a mating projection; and FIG. 19 is a cross sectional view of a "C"-shaped magnetic core material with multiple cavities and an eddy current reducing material.

DETAILED DESCRIPTION OF THE PREFERRED EMBODIMENTS

Figure 3:
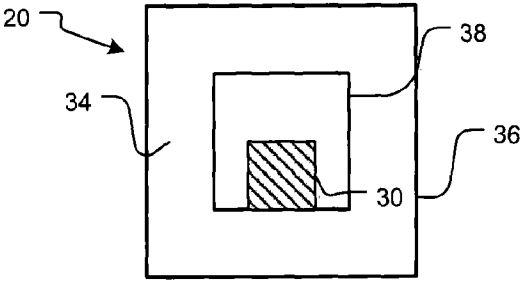
FIG. 3 Prior Art
FIG. 3 is a cross sectional view showing the power inductor of FIGS. 1 and 2 according to the prior art.
Figure 1:
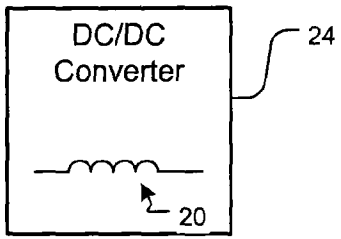
FIG. 1 Prior Art
FIG. 1 is a functional block diagram and electrical schematic of a power inductor implemented in an exemplary DC/DC converter according to the prior art.
Figure 2:
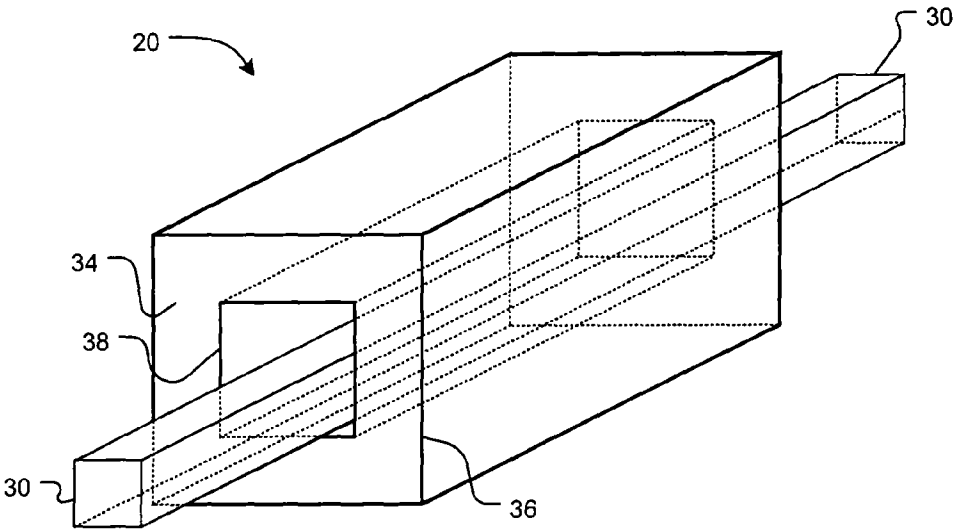
FIG. 2 Prior Art
FIG. 2 is a perspective view showing the power inductor of FIG. 1 according to the prior art.

The following description of the preferred embodiment(s) is merely exemplary in nature and is in no way intended to limit the invention, its application, or uses. For purposes of clarity, the same reference numbers will be used in the drawings to identify the same elements.

Figure 4:
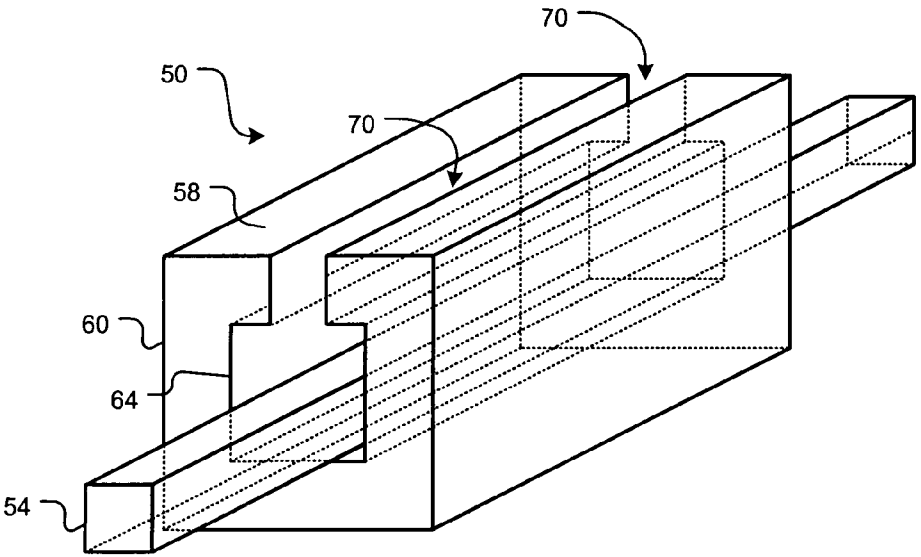
FIG. 4 is a perspective view showing a power inductor with a slotted air gap arranged in the magnetic core material according to the present invention.

Referring now to FIG. 4, a power inductor 50 includes a conductor 54 that passes through a magnetic core material 58. For example, the magnetic core material 58 may have a square outer cross-section 60 and a square central cavity 64 that extends the length of the magnetic core material. The conductor 54 may also have a square cross section. While the square outer cross section 60, the square central cavity 64, and the conductor 54 are shown, skilled artisans will appreciate that other shapes may be employed. The cross sections of the square outer cross section 60, the square central cavity 64, and the conductor 54 need not have the same shape. The conductor 54 passes through the central cavity 64 along one side of the cavity 64. The relatively high levels of DC current that flow through the conductor 30 tend to cause the magnetic core material 34 to saturate, which reduces performance of the power inductor and/or the device incorporating it.

According to the present invention, the magnetic core material 58 includes a slotted air gap 70 that runs lengthwise along the magnetic core material 58. The slotted air gap 70 runs in a direction that is parallel to the conductor 54. The slotted air gap 70 reduces the likelihood of saturation in the magnetic core material 58 for a given DC current level.

Figure 5:
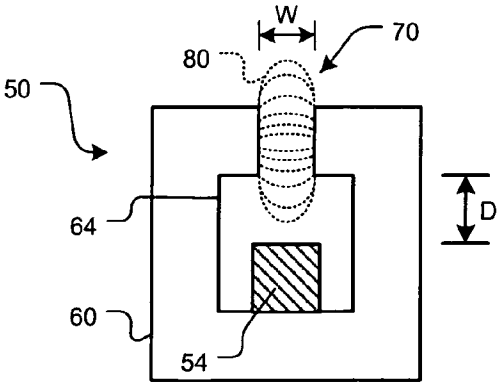
FIG. 5 is a cross sectional view of the power inductor of FIG. 4.

Referring now to FIG. 5, magnetic flux 80-1 and 80-2 (collectively referred to as flux 80) is created by the slotted air gap 70. Magnetic flux 80-2 projects towards the conductor 54 and induces eddy currents in the conductor 54. In a preferred embodiment, a sufficient distance "D" is defined between the conductor 54 and a bottom of the slotted air gap 70 such that the magnetic flux is substantially reduced. In one exemplary embodiment, the distance D is related to the current flowing through the conductor, a width "W" that is defined by the slotted air gap 70, and a desired maximum acceptable eddy current that can be induced in the conductor 54.

Figure 6A:
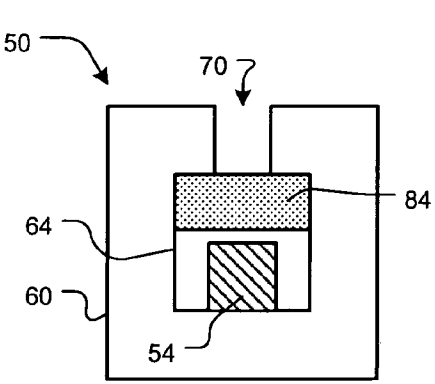
FIGS. 6A and 6B are cross sectional views showing alternate embodiments with an eddy current reducing material that is arranged adjacent to the slotted air gap.
Figure 6B:
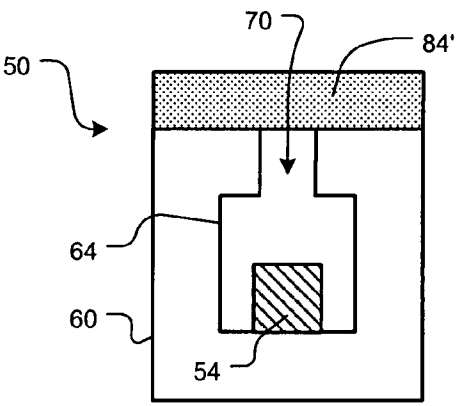

Referring now to FIGS. 6A and 6B, a eddy current reducing material 84 can be arranged adjacent to the slotted air gap 70. The eddy current reducing material has a lower magnetic permeability than the magnetic core material and a higher permability than air. As a result, more magnetic flux flows through the material 84 than air. For example, the magnetic insulating material 84 can be a soft magnetic material, a powdered metal, or any other suitable material. In FIG. 6A, the eddy current reducing material 84 extends across a bottom opening of the slotted air gap 70.

In FIG. 6B, the eddy current reducing material 84' extends across an outer opening of the slotted air gap. Since the eddy current reducing material 84' has a lower magnetic permeability than the magnetic core material and a higher magnetic permeability than air, more flux flows through the eddy current reducing material than the air. Thus, less of the magnetic flux that is generated by the slotted air gap reaches the conductor.

Figure 7:
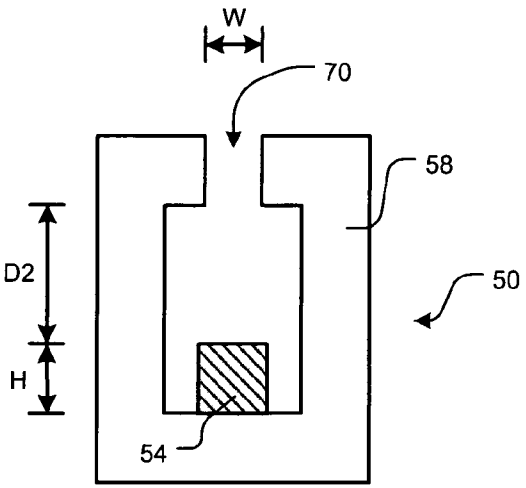
FIG. 7 is a cross sectional view showing an alternate embodiment with additional space between the slotted air gap and a top of the conductor.

For example, the eddy current reducing material 84 can have a relative permeability of 9 while air in the air gap has a relative permeability of 1. As a result, approximately 90% of the magnetic flux flows through the material 84 and approximately 10% of the magnetic flux flows through the air. As a result, the magnetic flux reaching the conductor is significantly reduced, which reduces induced eddy currents in the conductor. As can be appreciated, other materials having other permeability values can be used. Referring now to FIG. 7, a distance "D2" between a bottom the slotted air gap and a top of the conductor 54 can also be increased to reduce the magnitude of eddy currents that are induced in the conductor 54.

Figure 8:
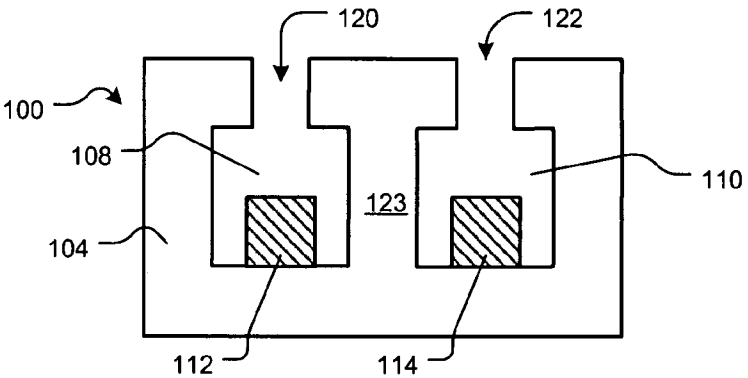
FIG. 8 is a cross sectional view of a magnetic core with multiple cavities each with a slotted air gap.

Referring now to FIG. 8, a power inductor 100 includes a magnetic core material 104 that defines first and second cavities 108 and 110. First and second conductors 112 and 114 are arranged in the first and second cavities 108 and 110, respectively. First and second slotted air gaps 120 and 122 are arranged in the magnetic core material 104 on a side that is across from the conductors 112 and 114, respectively. The first and second slotted air gaps 120 and 122 reduce saturation of the magnetic core material 104. In one embodiment, mutual coupling M is in the range of 0.5.

Figure 9A:
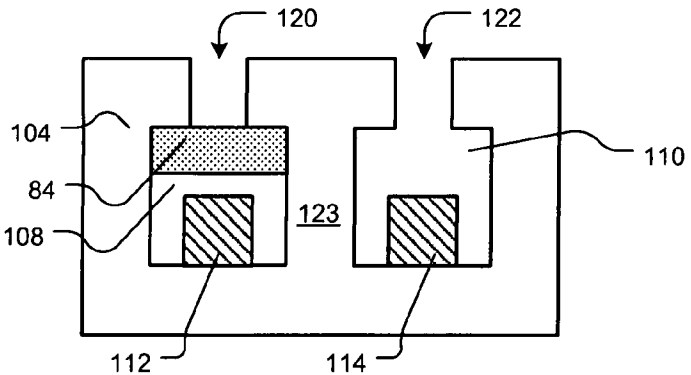
FIGS. 9A and 9B are cross sectional views of FIG. 8 with an eddy current reducing material arranged adjacent to one or both of the slotted air gaps.
Figure 9B:
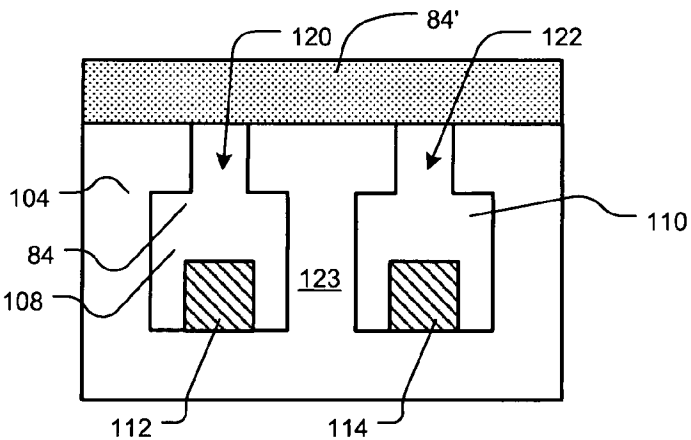

Referring now to FIGS. 9A and 9B, an eddy current reducing material is arranged adjacent to one or more of the slotted air gaps 120 and/or 122 to reduce magnetic flux caused by the slotted air gaps, which reduces induced eddy currents. In FIG. 9A, the eddy current reducing material 84 is located adjacent to a bottom opening of the slotted air gaps 120. In FIG. 9B, the eddy current reducing material is located adjacent to a top opening of both of the slotted air gaps 120 and 122. As can be appreciated, the eddy current reducing material can be located adjacent to one or both of the slotted air gaps. "T"-shaped central section 123 of the magnetic core material separates the first and second cavities 108 and 110.

Figure 10A:
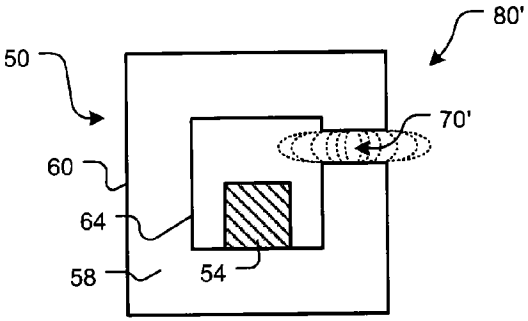
FIG. 10A is a cross sectional view showing an alternate side location for the slotted air gap.
Figure 10B:
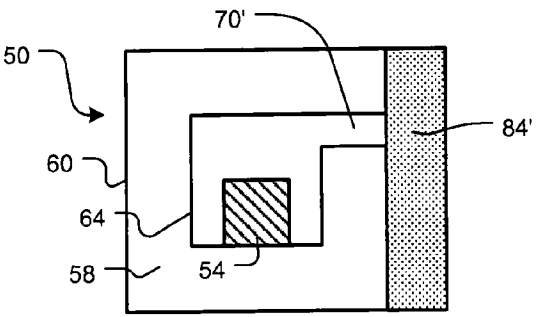
FIG. 10B is a cross sectional view showing an alternate side location for the slotted air gap.

The slotted air gap can be located in various other positions. For example and referring now to FIG. 10A, a slotted air gap 70' can be arranged on one of the sides of the magnetic core material 58. A bottom edge of the slotted air gap 70' is preferably but not necessarily arranged above a top surface of the conductor 54. As can be seen, the magnetic flux radiates inwardly. Since the slotted air gap 70' is arranged above the conductor 54, the magnetic flux has a reduced impact. As can be appreciated, the eddy current reducing material can arranged adjacent to the slotted air gap 70' to further reduce the magnetic flux as shown in FIGS. 6A and/or 6B. In FIG. 10B, the eddy current reducing material 84' is located adjacent to an outer opening of the slotted air gap 70'. The eddy current reducing material 84 can be located inside of the magnetic core material 58 as well.

Figure 11A:
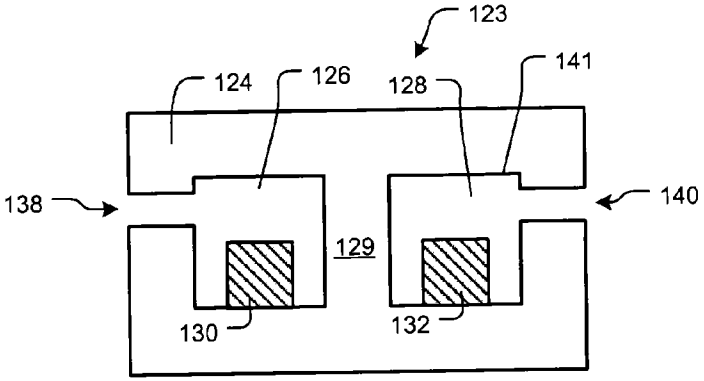
FIGS. 11A and 11B are cross sectional views of a magnetic core with multiple cavities each with a side slotted air gap.
Figure 11B:
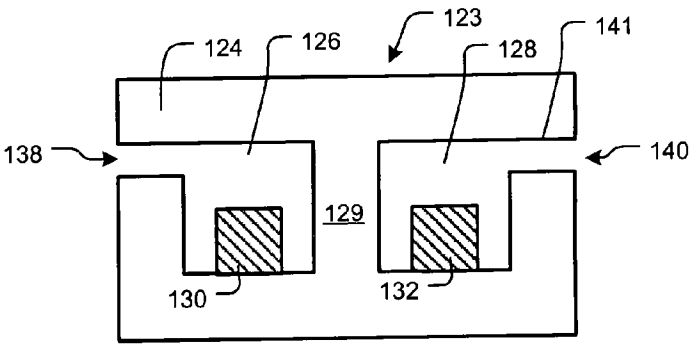

Referring now to FIGS. 11A and 11B, a power inductor 123 includes a magnetic core material 124 that defines first and second cavities 126 and 128, which are separated by a central portion 129. First and second conductors 130 and 132 are arranged in the first and second cavities 126 and 128, respectively, adjacent to one side. First and second slotted air gaps 138 and 140 are arranged in opposite sides of the magnetic core material adjacent to one side with the conductors 130 and 132. The slotted air gaps 138 and/or 140 can be aligned with an inner edge 141 of the magnetic core material 124 as shown in FIG. 11B or spaced from the inner edge 141 as shown in FIG. 11A. As can be appreciated, the eddy current reducing material can be used to further reduce the magnetic flux emanating from one or both of the slotted air gaps as shown in FIGS. 6A and/or 6B.

Figure 12:
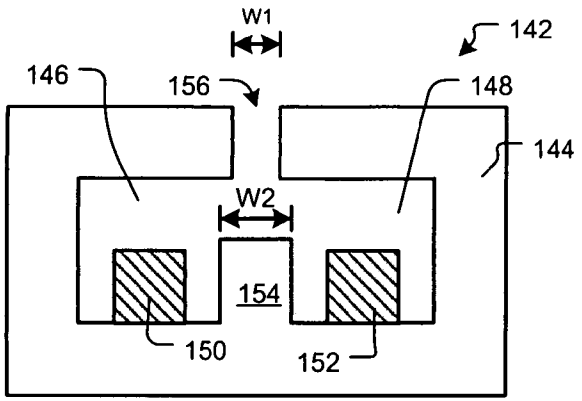
FIG. 12 is a cross sectional view of a magnetic core with multiple cavities and a central slotted air gap.
Figure 13:
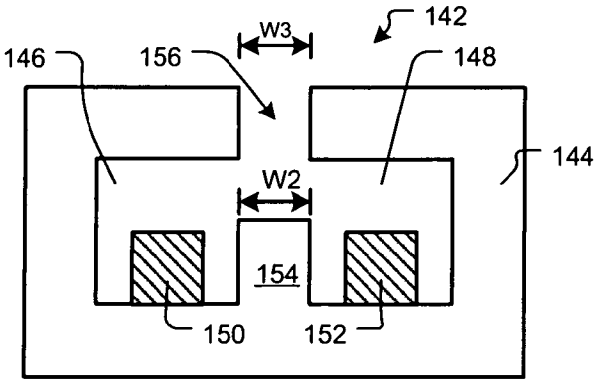
FIG. 13 is a cross sectional view of a magnetic core with multiple cavities and a wider central slotted air gap.
Figure 14:
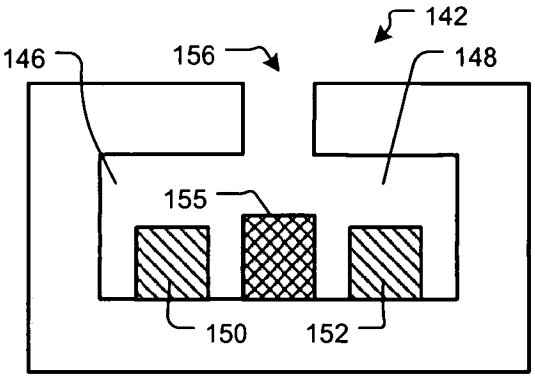
FIG. 14 is a cross sectional view of a magnetic core with multiple cavities, a central slotted air gap and a material having a lower permability arranged between adjacent conductors.
Figure 15:
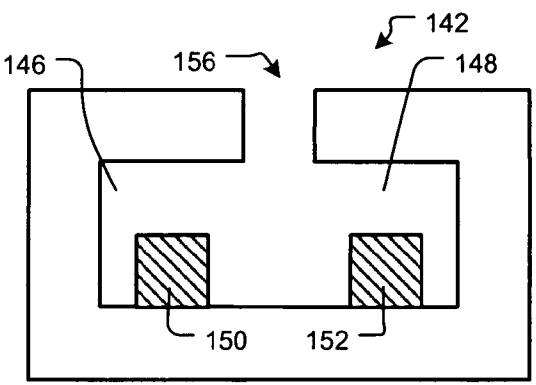
FIG. 15 is a cross sectional view of a magnetic core with multiple cavities and a central slotted air gap.

Referring now to FIGS. 12 and 13, a power inductor 142 includes a magnetic core material 144 that defines first and second connected cavities 146 and 148. First and second conductors 150 and 152 are arranged in the first and second cavities 146 and 148, respectively. A projection 154 of the magnetic core material 144 extends upwardly from a bottom side of the magnetic core material between the conductors 150 and 152. The projection 154 extends partially but not fully towards to a top side. In a preferred embodiment, the projection 154 has a projection length that is greater than a height of the conductors 150 and 154. As can be appreciated, the projection 154 can also be made of a material having a lower permability than the magnetic core and a higher permability than air as shown at 155 in FIG. 14. Alternately, both the projection and the magnetic core material can be removed as shown in FIG. 15. In this embodiment, the mutual coupling M is approximately equal to 1.

In FIG. 12, a slotted air gap 156 is arranged in the magnetic core material 144 in a location that is above the projection 154. The slotted air gap 156 has a width W1 that is less than a width W2 of the projection 154. In FIG. 13, a slotted air gap 156' is arranged in the magnetic core material in a location that is above the projection 154. The slotted air gap 156 has a width W3 that is greater than or equal to a width W2 of the projection 154. As can be appreciated, the eddy current reducing material can be used to further reduce the magnetic flux emanating from the slotted air gaps 156 and/or 156' as shown in FIGS. 6A and/or 6B. In some implementations of FIGS. 12–14, mutual coupling M is in the range of 1.

Referring now to FIG. 16, a power inductor 170 is shown and includes a magnetic core material 172 that defines a cavity 174. A slotted air gap 175 is formed in one side of the magnetic core material 172. One or more insulated conductors 176 and 178 pass through the cavity 174. The insulated conductors 176 and 178 include an outer layer 182 surrounding an inner conductor 184. The outer layer 182 has a higher permability than air and lower than the magnetic core material. The outer material 182 significantly reduces the magnetic flux caused by the slotted air gap and reduces eddy currents that would otherwise be induced in the conductors 184.

Referring now to FIG. 17, a power inductor 180 includes a conductor 184 and a "C"-shaped magnetic core material 188 that defines a cavity 190. A slotted air gap 192 is located on one side of the magnetic core material 188. The conductor 184 passes through the cavity 190. An eddy current reducing material 84' is located across the slotted air gap 192. In FIG. 18, the eddy current reducing material 84' includes a projection 194 that extends into the slotted air gap and that mates with the opening that is defined by the slotted air gap 192.

Referring now to FIG. 19, the power inductor 200 a magnetic core material that defines first and second cavities 206 and 208. First and second conductors 210 and 212 pass through the first and second cavities 206 and 208, respectively. A center section 218 is located between the first and second cavities. As can be appreciated, the center section 218 may be made of the magnetic core material and/or an eddy current reducing material. Alternately, the conductors may include an outer layer.

The conductors may be made of copper, although gold, aluminum, and/or other suitable conducting materials having a low resistance may be used. The magnetic core material can be Ferrite although other magnetic core materials having a high magnetic permeability and a high electrical resistivity can be used. As used herein, Ferrite refers to any of several magnetic substances that include ferric oxide combined with the oxides of one or more metals such as manganese, nickel, and/or zinc. If Ferrite is employed, the slotted air gap can be cut with a diamond cutting blade or other suitable technique.

While some of the power inductors that are shown have one turn, skilled artisans will appreciate that additional turns may be employed. While some of the embodiments only show a magnetic core material with one or two cavities each with one or two conductors, additional conductors may be employed in each cavity and/or additional cavities and conductors may be employed without departing from the invention. While the shape of the cross section of the inductor has be shown as square, other suitable shapes, such as rectangular, circular, oval, elliptical and the like are also contemplated.

The power inductor in accordance with the present embodiments preferably has the capacity to handle up to 100 Amps (A) of DC current and has an inductance of 500 nH or less. For example, a typical inductance value of 50 nH is used. While the present invention has been illustrated in conjunction with DC/DC converters, skilled artisans will appreciate that the power inductor can be used in a wide variety of other applications.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, the specification and the following claims.

What is claimed is:

1. A power inductor comprising:

a magnetic core material having first and second ends;

an inner cavity arranged in said magnetic core material that extends from said first end to said second end;

a conductor that passes through said cavity;

a slotted air gap arranged in said magnetic core material that extends from said first end to said second end; and an eddy current reducing material that is arranged adjacent to at least one of an inner opening of said slotted air gap in said cavity between said slotted air gap and said conductor and an outer opening of said slotted air gap, wherein said eddy current reducing material has a permeability that is lower than said magnetic core material.

2. The power inductor of claim 1 wherein said power inductor is implemented in a DC/DC converter.

3. The power inductor of claim 1 wherein said slotted air gap is arranged in said magnetic core material in a direction that is parallel to said conductor.

4. The power inductor of claim 1 wherein a cross sectional shape of said magnetic core material is square.

5. The power inductor of claim 1 wherein said conductor includes an insulating material arranged on an outer surface thereof.

6. The power inductor of claim 1 wherein said conductor passes through said cavity along a first side of said magnetic core material and said slotted air gap is arranged in a second side of said magnetic core material that is opposite said first side.

7. The power inductor of claim 6 wherein a second conductor passes through said cavity along said first side.

8. The power inductor of claim 1 wherein a cross sectional shape of said magnetic core material is one of square, circular, rectangular, elliptical, and oval.

9. The power inductor of claim 1 wherein said conductor passes through said cavity along a first side of said magnetic core material and said slotted air gap is arranged in a second side that is adjacent to said first side.

10. The power inductor of claim 9 further comprising:

a second cavity arranged in said magnetic core material;

a center section of said magnetic core material that is arranged between said cavity and said second cavity;

a second conductor that passes through said second cavity adjacent to said first side; and a second slotted air gap arranged in a third side that is opposite to said second side.

11. The power inductor of claim 1 wherein said eddy current reducing material has a low magnetic permeability.

12. The power inductor of claim 11 wherein said eddy current reducing material comprises a soft magnetic material.

13. The power inductor of claim 12 wherein the soft magnetic material comprises a powdered metal.

14. A power inductor comprising:

a magnetic core material having first and second ends;

an inner cavity arranged in said magnetic core material that extends from said first end to said second end;

a conductor that passes through said cavity;

a slotted air gap arranged in said magnetic core material that extends from said first end to said second end, wherein said conductor passes through said cavity along a first side of said magnetic core material and said slotted air gap is arranged in a second side of said magnetic core material that is opposite said first side;

a second conductor passes through said cavity along said first side; and a projection of said magnetic core material that extends outwardly from said first side between said conductor and said second conductor.

15. The power inductor of claim 14 wherein said slotted air gap is arranged in said opposite side of said magnetic core material above said projection.

16. The power inductor of claim 14 wherein said projection includes a material having a permeability lower than said magnetic core material.

17. The power inductor of claim 16 wherein said material comprises a soft magnetic material.

18. The power inductor of claim 17 wherein the soft magnetic material comprises a powdered metal.

19. A power inductor comprising:

a magnetic core material having first and second ends;

an inner cavity arranged in said magnetic core material that extends from said first end to said second end;

a conductor that passes through said cavity;

a slotted air gap arranged in said magnetic core material that extends from said first end to said second end;

a second cavity in said magnetic core material;

a center "T"-shaped section arranged in said magnetic core material between said cavity and said second cavity; and a second conductor that passes through said second cavity adjacent to said first side, wherein said first conductor is arranged adjacent to said first side.

20. The power inductor of claim 19 wherein said slotted air gap is arranged in a second side that is opposite said first side on one side of said center "T"-shaped section and a second slotted air gap is arranged in said second side that is opposite said first side on an opposite side of said center "T"-shaped section.

21. The power inductor of claim 19 wherein said slotted air gap is arranged in a second side of said magnetic core material that is adjacent to said first side and wherein a second slotted air gap is arranged in a third side that is opposite said second side.

22. A method for reducing saturation in a power inductor, comprising:

forming an inner cavity in a magnetic core material having first and second ends, wherein said inner cavity extends from said first end to said second end;

passing a conductor through said cavity;

providing a slotted air gap in said magnetic core material that extends from said first end to said second end; and locating an eddy current reducing material adjacent to at least one of an inner opening of said slotted air gap in said cavity between said slotted air gap and said conductor and an outer opening of said slotted air gap.

23. The method of claim 22 further comprising locating said slotted air gap in said magnetic core material in a direction that is parallel to said conductor.

24. The method of claim 22 wherein said power inductor is implemented in a DC/DC converter.

25. The method of claim 22 wherein a cross sectional shape of said magnetic core material is square.

26. The method of claim 22 wherein said conductor includes an insulating material arranged on an outer surface thereof.

27. The method of claim 22 wherein a cross sectional shape of said magnetic core material is one of square, circular, rectangular, elliptical, and oval.

28. The method of claim 22 further comprising:

passing said conductor through said cavity along a first side of said magnetic core material;

arranging said slotted air gap along a second side of said magnetic core material that is opposite said first side.

29. The method of claim 28 further comprising passing a second conductor through said cavity along said first side.

30. The method of claim 22 further comprising:

passing said conductor through said cavity along a first side of said magnetic core material; and arranging said slotted air gap in a second side that is adjacent to said first side.

31. The method of claim 30 further comprising:

providing a second cavity in said magnetic core material;

locating a center section of said magnetic core material between said cavity and said second cavity;

passing a second conductor through said second cavity adjacent to said first side; and providing a second slotted air gap in a third side that is opposite to said second side.

32. The method of claim 22 wherein said eddy current reducing material has a low magnetic permeability.

33. The method of claim 32 wherein said eddy current reducing material comprises a soft magnetic material.

34. The method of claim 33 wherein the soft magnetic material comprises a powdered metal.

35. A method for reducing saturation in a power inductor, comprising:

forming an inner cavity in a magnetic core material having first and second ends, wherein said inner cavity extends from said first end to said second end;

passing a conductor through said cavity;

providing a slotted air gap in said magnetic core material that extends from said first end to said second end;

providing a second cavity in said magnetic core material;

locating a center "T"-shaped section of said magnetic core material between said cavity and said second cavity; and passing a second conductor through said second cavity adjacent to said first side, wherein said first conductor is arranged adjacent to said first side.

36. The method of claim 35 further comprising:

locating said slotted air gap in a second side that is opposite said first side on one side of said center "T"-shaped section; and locating a second slotted air gap in said second side that is opposite said first side on an opposite side of said center "T"-shaped section.

37. The method of claim 35 further comprising:

locating said slotted air gap in a second side of said magnetic core material that is adjacent to said first side; and locating a second slotted air gap in a third side that is opposite said second side.

38. A method for reducing saturation in a power inductor, comprising:

forming an inner cavity in a magnetic core material having first and second ends, wherein said inner cavity extends from said first end to said second end;

passing a conductor through said cavity;

providing a slotted air gap in said magnetic core material that extends from said first end to said second end;

passing said conductor through said cavity along a first side of said magnetic core material;

arranging said slotted air gap along a second side of said magnetic core material that is opposite said first side;

passing a second conductor through said cavity along said first side; and extending a projection of said magnetic core material outwardly from said first side between said conductor and said second conductor.

39. The method of claim 38 further comprising arranging said slotted air gap in said opposite side of said magnetic core material above said projection.

40. The method of claim 38 wherein said projection comprises a material having a permability that is lower than said magnetic core material.

41. The method of claim 40 wherein said material comprises a soft magnetic material.

42. The method of claim 41 wherein the soft magnetic material comprises a powdered metal.

43. A power inductor comprising:

magnetic core means for conducting a magnetic field and having first and second ends;

cavity means arranged in said magnetic core means that extends from said first end to said second end for receiving conducting means for conducting current;

slot means arranged in said magnetic core means that extends from said first end to said second end for reducing saturation of said magnetic core means, wherein said conducting means passes through said cavity means along a first side of said magnetic core means and said slot means is arranged in a second side of said magnetic core means that is opposite said first side;

second conducting means that passes through said cavity means along said first side for conducting current; and projection means for extending outwardly from said first side between said conducting means and said second conducting means.

44. The power inductor of claim 43 wherein said slot means is arranged in said opposite side of said magnetic core means above said projection means.

45. The power inductor of claim 43 wherein said projection means comprises a material having a lower permeability than said magnetic core means.

46. The power inductor of claim 45 wherein said material comprises a soft magnetic material.

47. The power inductor of claim 46 wherein the soft magnetic material comprises a powdered metal.

48. A power inductor comprising:

magnetic core means for conducting a magnetic field and having first and second ends;

cavity means arranged in said magnetic core means that extends from said first end to said second end for receiving conducting means for conducting current;

slot means arranged in said magnetic core means that extends from said first end to said second end for reducing saturation of said magnetic core means; and second cavity means in said magnetic core means for receiving second conducting means for conducting current, wherein said magnetic core means includes a center "T"-shaped section located between said cavity means and said second cavity means; and wherein second conducting means is arranged adjacent to said first side, and wherein said first conducting means is arranged adjacent to said first side.

49. The power inductor of claim 48 wherein said slot means is arranged in a second side that is opposite said first side on one side of said center "T"-shaped section and second slot means for reducing saturation and that is arranged in said second side that is opposite said first side on an opposite side of said center "T"-shaped section.

50. The power inductor of claim 48 wherein said slot means is arranged in a second side of said magnetic core means that is adjacent to said first side and wherein second slot means for reducing saturation is arranged in a third side that is opposite said second side.

51. A power inductor comprising:

magnetic core means for conducting a magnetic field and having first and second ends;

cavity means arranged in said magnetic core means that extends from said first end to said second end for receiving conducting means for conducting current;

slot means arranged in said magnetic core means that extends from said first end to said second end for reducing saturation of said magnetic core means; and eddy current reducing means, that is arranged at least one of adjacent to an inner opening of said slot means in said cavity means between said slot means and said conducting means and adjacent to an outer opening of said slot means, for reducing magnetic flux reaching said conducting means.

52. The power inductor of claim 51 wherein said power inductor is implemented in a DC/DC converter.

53. The power inductor of claim 51 wherein said slot means is arranged in said magnetic core means in a direction that is parallel to said conducting means.

54. The power inductor of claim 51 wherein a cross sectional shape of said magnetic core means is square.

55. The power inductor of claim 51 wherein said conducting means includes insulating means formed around said conducting means for insulating said conducting means.

56. The power inductor of claim 51 wherein a cross sectional shape of said magnetic core means is one of square, circular, rectangular, elliptical, and oval.

57. The power inductor of claim 51 wherein said conducting means passes through said cavity means along a first side of said magnetic core means and said slot means is arranged in a second side of said magnetic core means that is opposite said first side.

58. The power inductor of claim 57 further comprising second conducting means that passes through said cavity means along said first side for conducting current.

59. The power inductor of claim 51 wherein said conducting means passes through said cavity means along a first side of said magnetic core means and said slot means is arranged in a second side that is adjacent to said first side.

60. The power inductor of claim 59 further comprising:

second cavity means arranged in said magnetic core means for receiving second conducting means for conducting current, wherein said magnetic core means includes a center section that is arranged between said cavity means and said second cavity means, wherein said second conducting means is arranged adjacent to said first side; and second slot means arranged in a third side that is opposite to said second side for reducing saturation of said magnetic core means.

61. The power inductor of claim 51 wherein said second means has a low magnetic permeability.

62. The power inductor of claim 61 wherein said second means comprises a soft magnetic material.

63. The power inductor of claim 62 wherein the soft magnetic material comprises a powdered metal.

64. A power inductor comprising:

a magnetic core material having first and second ends;

an inner cavity arranged in said magnetic core material that extends from said first end to said second end;

a conductor that passes through said cavity; and a slotted air gap arranged in said magnetic core material that extends from said first end to said second end, wherein said magnetic core material has a "C"-shaped cross section that defines an air gap and further including an eddy current reducing material that is located across said air gap and that has a permeability that is lower than said magnetic core material.

65. The power inductor of claim 64 wherein said eddy current reducing material includes a projection that extends and into said slotted air gap.

66. A method for reducing saturation in a power inductor, comprising:

forming an inner cavity in a magnetic core material having first and second ends, wherein said inner cavity extends from said first end to said second end;

passing a conductor through said cavity;

providing a slotted air gap in said magnetic core material that extends from said first end to said second end;

defining a "C"-shaped cross section and an air gap with said magnetic core material; and positioning an eddy current reducing material across said air gap, wherein said eddy current reducing material has a permeability that is lower than said magnetic core material.

67. The method of claim 66 wherein said eddy current reducing material includes a projection that extends into said slotted air gap.

68. A power inductor comprising:

magnetic core means for conducting a magnetic field and having first and second ends;

cavity means arranged in said magnetic core means that extends from said first end to said second end for receiving conducting means for conducting current;

slot means arranged in said magnetic core means that extends from said first end to said second end for reducing saturation of said magnetic core means, wherein said magnetic core means has a "C"-shaped cross section that defines an air gap; and eddy current reducing means, that is located across said air gap, for reducing magnetic flux reaching said conducting means.

69. The power inductor of claim 68 wherein said second means includes projection means that extends into said slotted air gap for further reducing said magnetic flux.

* * * * *

UNITED STATES PATENT AND TRADEMARK OFFICE

CERTIFICATE OF CORRECTION

PATENT NO. : 7,023,313 B2
APPLICATION NO. : 10/621128
DATED : April 4, 2006
INVENTOR(S) : Sehat Sutardja It is certified that error appears in the above-identified patent and that said Letters Patent is hereby corrected as shown below:

| | |
|---|---|
| Column 4, Line 36: | Insert --of-- after “bottom” |
| Column 5, Line 5: | Insert --be-- after “can” |
| Column 5, Line 38: | Delete “permability” and insert --permeability-- |
| Column 5, Line 39: | Delete “permability” and insert --permeability-- |
| Column 5, Line 63: | Delete “permability” and insert --permeability-- |
| Column 6, Line 39: | Delete “be” and insert --been-- |
| Column 9, Line 64: | Delete “permability” and insert --permeability-- |

Signed and Sealed this

Twenty-sixth Day of December, 2006

JON W. DUDAS
*Director of the United States Patent and Trademark Office*